United States Patent [19]

Mergenthaler

[11] 4,153,969

[45] May 15, 1979

[54] DEVICE FOR INTRODUCING DRAPERY (CURTAIN) HOLDING ELEMENTS INTO A DRAPERY (CURTAIN) ROD

[76] Inventor: Hans Mergenthaler, Stettfelderstr. 18, 8729 Ebelsbach, Fed. Rep. of Germany

[21] Appl. No.: 876,003

[22] Filed: Feb. 8, 1978

Related U.S. Application Data

[63] Continuation-in-part of Ser. No. 785,417, Apr. 7, 1977.

[51] Int. Cl.[2] ..... A47H 1/04; E05D 13/02

[52] U.S. Cl. ..... 16/87 R; 160/345; 16/95 D

[58] Field of Search ..... 16/87 R, 93 R, 93 D, 16/94 R, 94 D, 95 R, 95 D, 96 R, 96 D; 160/345, 346, 126, 330

[56] References Cited

U.S. PATENT DOCUMENTS

| | | | |
|---|---|---|---|
| 336,610 | 2/1886 | Weber | 160/345 |
| 1,942,712 | 1/1934 | Kirsch | 160/345 |
| 3,337,903 | 8/1967 | Kenney | 160/345 X |
| 3,521,317 | 7/1970 | Ford | 160/346 X |
| 3,587,130 | 6/1971 | Graf | 16/95 D |
| 3,881,219 | 5/1975 | Haarer | 160/345 X |

FOREIGN PATENT DOCUMENTS

| | | | |
|---|---|---|---|
| 1106042 | 5/1961 | Fed. Rep. of Germany | 16/95 D |
| 2256761 | 3/1974 | Fed. Rep. of Germany | 16/95 D |
| 2351261 | 4/1975 | Fed. Rep. of Germany | 16/95 D |

*Primary Examiner*—Louis Rimrodt
*Assistant Examiner*—Moshe I. Cohen
*Attorney, Agent, or Firm*—Price and Caslin

[57] ABSTRACT

The invention relates to a device for introducing and extracting drapery holding elements by hand or by means of an auxiliary rod in and out of an opening in the slideway of a drapery rod of a down-turned C-shaped cross-section, wherein the opening is closable by means of a removable insert piece and which comprises a channel for the drapery holding elements protruding from the channel through a slot formed between the angle portions of the C-form. The insert piece comprises a zone of C-shaped cross-section which is shorter than the opening, comprising at one end an extension insertable into the channel of the drapery rod under the angle portions thereof and comprising at the other end two elastic tongues extending the angle portions of the C zone and slidable under the angle portions of the drapery rod, the length of the C zone and tongues being greater than the length of the opening.

10 Claims, 14 Drawing Figures

Fig. 9
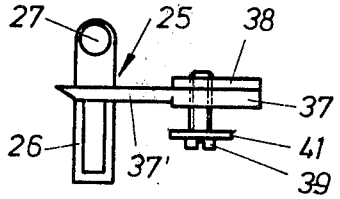
Fig 10
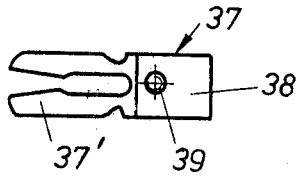
Fig. 14
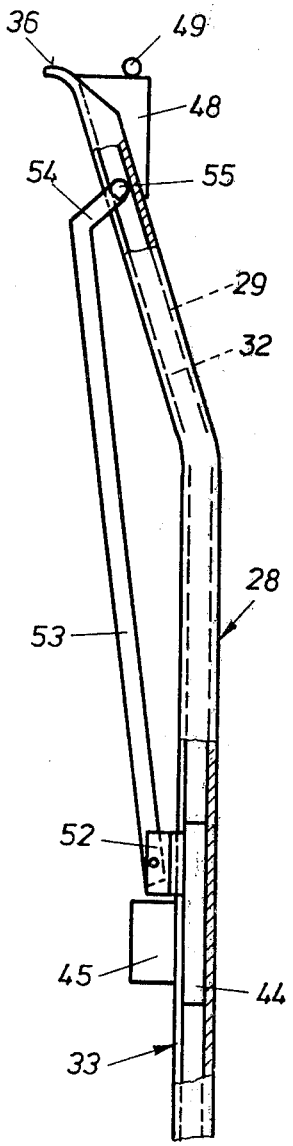
Fig.11
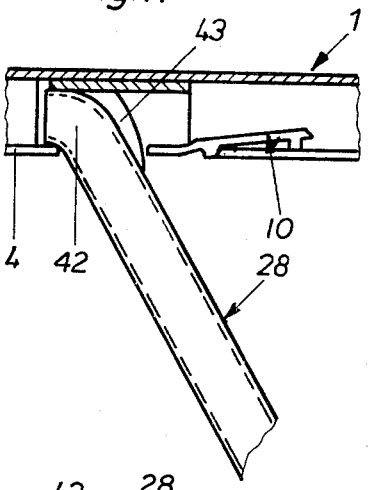
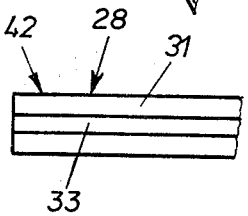
Fig.12
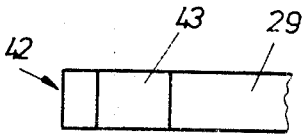
Fig.13

DEVICE FOR INTRODUCING DRAPERY (CURTAIN) HOLDING ELEMENTS INTO A DRAPERY (CURTAIN) ROD

CROSS REFERENCE TO RELATED APPLICATION

This application is a continuation-in-part application of copending patent application Ser. No. 785,417 entitled "Apparatus For Installing Drapery Hangers In A Drapery Rod" which was filed in the U.S. on Apr. 7, 1977.

The invention aims at several improvements of this earlier device. The functions and advantages of the invention will become evident specifically from the following description and drawing of the improvements.

SUMMARY OF THE INVENTION

The invention provides that at least one of the tongues of the insert piece carries on the outside, near its free end, a stop which, when the extension is pushed into the channel, bears against the edge associated with the tongues, of the opening of the C-shaped drapery rod and is slidable with the tongues under the angle portions of the drapery rod. With this design, the insert piece is not held by clamping in its position closing the opening of the drapery rod. In this position, instead, it is locked by the stop provided at the elastic tongues. The stop is pressed and pushed under the angle portions of the drapery rod when the insert piece is displaced in such a way that it clears a part of the opening so as to be able to introduce or extract holding elements in or out of the drapery rod.

The invention also provides that, at the free end of the auxiliary rod, the transverse member of the auxiliary rod comprises a guide extension symmetrically tapered in width. This tapered guide extension can simply be introduced into the slot of the drapery rod, whereby the auxiliary rod assumes the necessary symmetrical position to the drapery rod. The tapered guide extension is especially useful when the insert piece is to be displaced. However, the tapered guide extension is of advantage also when the auxiliary rod is to be introduced into the opening of the drapery rod in such a way that drapery holding elements are to be pushed by the auxiliary rod into the drapery rod.

The invention further provides that, at the free end of the auxiliary rod, bent tongues prolonging the angle portions of the auxiliary rod are provided. These bent tongues are inserted through the opening of the drapery rod cleared by the insert piece and are placed on the inside of the angle portions of the drapery rod. The drapery holding elements now slide in an improved manner from the auxiliary rod into the drapery rod.

The invention further provides that, spaced from the free end, the auxiliary rod carries at the transverse member a supporting member of frictional material. By this supporting member the auxiliary rod takes support on the drapery rod when it is applied to the drapery rod in such a way that drapery holding elements are to be brought out of the auxiliary rod into the drapery rod. Further the supporting member serves for the improved operation of the insert pieces, because with the supporting member one can take hold at the areas of the insert piece extending downwardly over the drapery rod, in order to push the tongues thereof under the angle portions of the drapery rod. With the supporting member not only can the tongues be bent into the channel, but also the insert piece can be displaced.

The invention also provides that the terminal areas of the tongues at the free end of the auxiliary rod and the top side of the supporting member run approximately parallel to each other. This design makes it easier to hold the auxiliary rod relative to the drapery rod exactly in that position which must exist if the drapery holding elements are to be pushed easily from the auxiliary rod into the drapery rod.

The invention further provides that on the auxiliary rod a rigid intermediate piece is fastened, on which a supporting member is secured. This is a particularly appropriate manner of applying the supporting member to the auxiliary rod.

The invention also provides that at the end of the drapery rod, in the channel a closure piece is arranged, which is fastened on the angle portions of the drapery rod by means of a clamping screw and possesses in the channel a pair of elastically spring-supported ratchet tongues, between which a leg or bridge-piece of one of the drapery holding elements is engageable. The first holding element, introduced through the opening in the area of the insert piece into the channel of the drapery rod, is pressed with its bridge-piece against and between the two ratchet tongues which due to their shape hold the bridge-piece fast between them. In normal use or normal displacement of the drapery, the holding element does not release from the hold of the ratchet tongues. But if the holding element is pulled away from the ratchet tongues in longitudinal direction of the drapery rod with increased force, it is released by the ratchet tongues, and the holding elements of the drapery can all be taken out of the drapery rod through the opening.

The invention further provides that at the end of the auxiliary rod, at the bridge-piece thereof, a lug extending over the width of the bridge-piece is provided which, when the end of the auxiliary rod is pushed into the opening, applies against the transverse member of the insert piece and against the angle portions of the C-zone of the insert piece. With this design of the auxiliary rod, a lug engaging into the slot of the drapery rod or of the insert piece and lugs taking support on the underside of the drapery rod or of the insert piece are superfluous. The auxiliary rod introduced through the opening into the insert piece is supported at the transverse member of the insert piece and holds the opening open by holding the insert piece in its pushed-back position.

Then also the invention provides a modification that has a rigid straight push bar disposed in the auxiliary rod. Outside the auxiliary rod, an arm is articulated whose other end carries a transverse member which is displaceably guided in the channel of the auxiliary rod. This design of the pushing means can be used both with a curved and with a straight auxiliary rod without the need for a flexible front region of the push bar. When the auxiliary rod is inserted with its front end in the curtain rod, the transverse member pushed drapery holding elements out of the auxiliary rod into the drapery rod, the transverse member being able to change over from the auxiliary rod to the drapery rod, in order to push the holding elements far enough into the drapery rod.

The present invention constitutes preferred improvements of the invention according to the earlier copending patent application Ser. No. 785,417 which was filed in the U.S. on Apr. 7, 1977, the disclosure of which is hereby expressly referred to, without repeating here the disclosure thereof in detail. The present invention, however, is usable at least in some of the improvements also independently of the invention of the older patent application. Combinations of the individual improvements of the present application constitute preferred embodiments of the invention.

BRIEF DESCRIPTION OF THE DRAWINGS

In the drawing, preferred embodiments of the invention are represented,

FIG. 9, a side view of a closure piece with a drapery holding element;

FIG. 10, a view from above onto the closure piece according to FIG. 9;

FIG. 11, a side view of a second modification of an auxiliary rod with lug inserted in a drapery rod;

FIG. 12, a view from below of the auxiliary rod according to the modification of FIG. 11;

FIG. 13, a view from above of the auxiliary rod according to FIG. 11; and FIG. 14, a side view of a third modification of an auxiliary rod and having a push bar with articulated arm.

Figure 1:
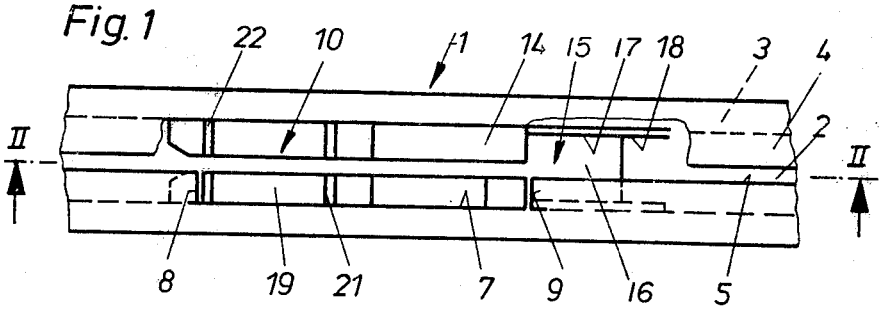
FIG. 1 showing a view from below with bridging of a portion of a drapery rod with an insert piece.
Figure 2:
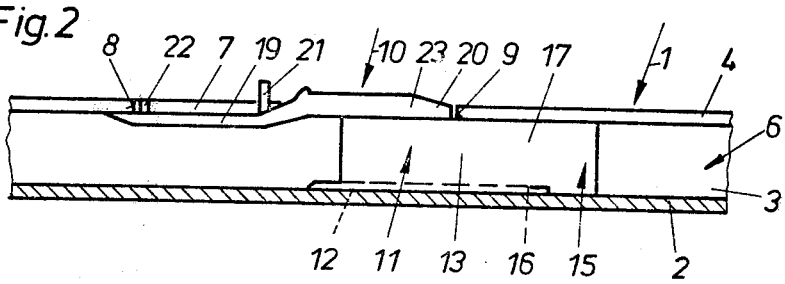
FIG. 2, a cross-sectional view along line II-II in FIG. 1.

All embodiments shown in the drawing include a drapery rod 1 illustrated in FIGS. 1 and 2, whose cross-section is substantially C-shaped and which comprises a transverse member 2, two legs 3 thereon, and on eash has an angle portion 4. The two angle portions 4 define a slot 5. Transverse member 2, legs 3 and angle portions 4 enclose a channel 6. In channel 6 are arranged guide bodies, e.g. rollers, of drapery holding elements 25, shown in FIG. 9 which protrude through the slot with legs or bridge-pieces, on which a drapery is attached.

Drapery rod 1 has, e.g. in the center, an opening 7, which has been formed by removal of a certain piece or section of the angle portions 4. The angle portions 4 thus form at the narrow sides of the opening 7 edges 8, 9 which define the opening. An insert piece 10 is inserted in the rod 1 through the opening 7.

Approximately in the center, the insert piece 10 has a zone 11 of C-shaped cross-section, which possesses a transverse member 12, two legs 13 and two angle portions 14. The transverse member 12 protrudes over the legs 13 in longitudinal direction. The angle portions 14 define a slot whose width corresponds to the width of slot 5 of the drapery rod. At one end of the C zone 11 an extension 15 of U-shaped cross-section is provided, whose transverse member 16 prolongs the transverse member 12 and whose two legs 17 each prolong one of the two legs 13. In transverse member 16 a recess 18 is provided, which is open toward the free end of the extension 15.

At the end of the C zone 11 opposite the extension 15, two tongues 19 are provided, which each prolong one of the two angle portions 14 of the C zone. The two tongues define between them a slot whose width corresponds to the width of slot 5. The thickness of the tongue 19 tapers toward their free ends. On the outside of at least one of the two angle portions 14, the C zone 11 caries a stop 20. At least one of the tongues 19 carries at its outside, approximately in the center, a stop 21.

Each of the two tongues 19 of the insert piece 10 carries, near its free end, a stop 22, which, when extension 15 is pushed into channel 6 according to FIGS. 1 and 2, bears against the edge 8 of opening 7 associated with the tongues and can be pushed with the tongues under the angle portions 4 of drapery rod 1. The insert piece 10 protrudes over the drapery rod 1 according to FIGS. 1 and 2 not only with its thickened region 23 of the C-shaped zone 11, cut also with the stop 21.

Figure 5:
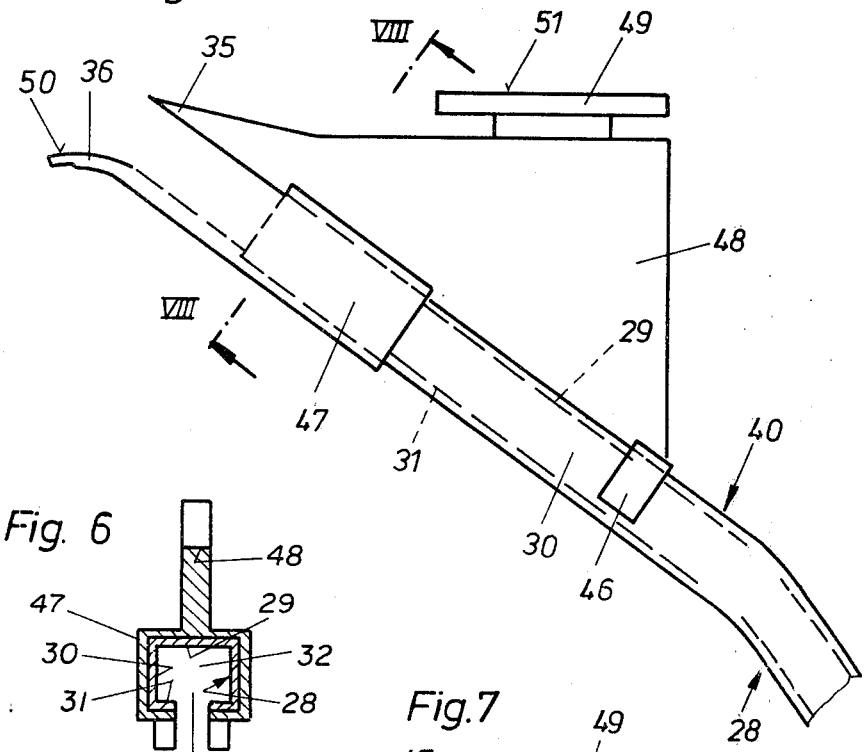
FIG. 5, a side view of a free end piece of an auxiliary rod with supporting member.
Figure 6:
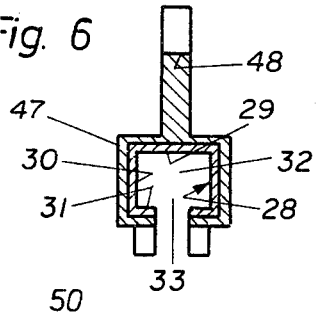
FIG. 6, a transverse cross-sectional view taken along line VIII–VIII in FIG. 5.
Figure 7:
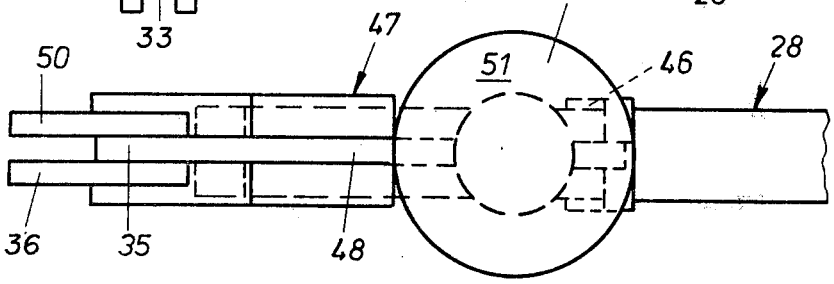
FIG. 7, a top plan of the auxiliary rod end-piece according to FIG. 5.
Figure 8:
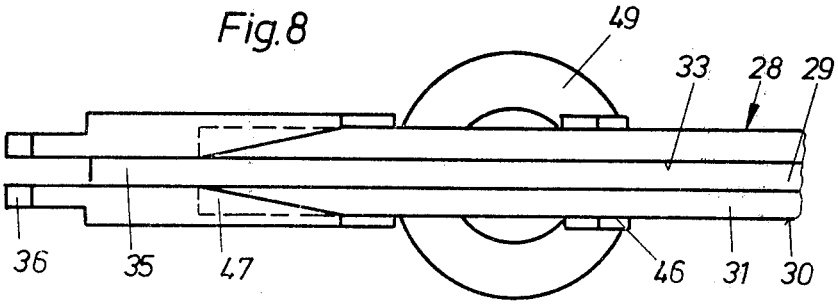
FIG. 8, a view from below of the auxiliary rod end-piece according to FIG. 5.

It is advantageous also, however, if the insert piece 10, when the opening 7 is fully closed, does not protrude over the lower face of the drapery rod. Depending on the shape of the free end piece of the auxiliary rod such as 28 in FIG. 5, the insert piece 10 is made to project relative to the lower face of the rod or not. A modified form of an insert piece also has two stops for fixing the insert piece in the opening of the rod and a stop for fixing the insert piece when the opening is cleared. On the underside of the angle portions of the C-shaped zone, recesses are provided, into which a suitable part of the free end piece of the auxiliary rod is inserted, to displace the insert piece. Stops 21 and 22 have rounded or beveled flanks, to be able to overcome the resistance of these stops by pressure in the longitudinal direction of the drapery rod.

FIGS. 3 to 8 to 11 to 14 show several modifications of an auxiliary rod 28 of C-shaped cross-section which comprises a transverse member 29, two legs 30 and two angle portions 31. In the channel 32 of the auxiliary rod 28 the drapery holding elements which are to be loaded into the drapery rod 1, can be arranged, the auxiliary rod 28 having between the two angle portions 31 a slot 33 which corresponds to slot 5 of the drapery rod 1 as to width. A push bar may be displaceably guided in the auxiliary rod 28.

Figure 3:
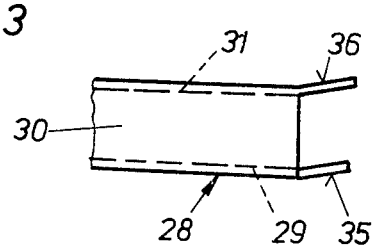
FIG. 3, a side view of the free end piece of an auxiliary rod.
Figure 4:
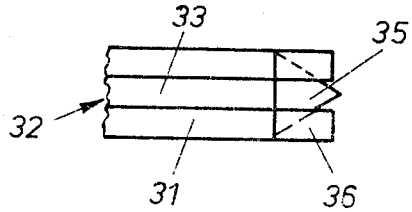
FIG. 4, a top view of the auxiliary rod according to FIG. 3.

According to FIGS. 3 and 4, the auxiliary rod 28 terminates in a straight line and possesses a substantially plane end face. The transverse member 29 is prolonged beyond this end face in a guide extension 35 which is slightly inclined toward the angle portions 31 and tapers in width toward its front end in the manner of a point. At the free end of the auxiliary rod 28, tongues 36 which prolong the angle portions 31 and which are inclined away from the transverse member 29 are provided.

According to FIGS. 5 to 8, the auxiliary rod 28 has a slight curvature 40 toward the front. On the front end of the auxiliary rod an attachment is mounted, which has at one end two flanges 46 bearing against the legs 30. Toward the front end the attachment has a C zone 47, which bears against the legs 30 and also against the angle portions 31 of the auxiliary rod 28. The attachment is seated 28 toward the front by a pointed guide extension 35 which is insertable into the slot 5 of the drapery rod 1. The attachment further protrudes over the auxiliary rod 28 by two bent tongues 36 which can be pushed into the opening 7 of the drapery 1 and be placed on the angle portions 4 thereof. Above the transverse member 29 the attachment comprises an intermediate piece 48, rigid in itself, which carries a supporting member 49 of soft material, e.g. rubber. The terminal areas 50 of the tongues 36 and the top side 51 of the supporting member 49 are approximately parallel to each other.

In a modification of the embodiment according to FIGS. 5 to 8, the guide extension 35 may be omitted. The supporting member 49 may be of an inherently rigid plastic and possess a surface 51 which is knurled or has an improved grip. Alternatively the supporting member 49 may be made of so soft a material that under slight pressure it fits into the contours and unevenesses of the insert piece.

FIG. 9 shows a drapery holding element 25, having a U shaped bridge-piece 26 to which a roller 27 is fastened. According to FIGS. 9 and 10, a closure piece 37 is provided which has two ratchet tongues 37' of resilient plastic which form between them a slot with an enlargement into which the bridge-piece 26 is insertable with outward bending of the ratchet tongues. The closure piece 37 further comprises a part 38 with threaded bore, into which a clamping screw 39 with shim 41 can be screwed. The closure piece 37 is pushed into the channel of the drapery rod or of the auxiliary rod, the shim applying against the outer side of the angle portions of the rod. By tightening the clamping screw 39, the closure piece 37 is fixed on the angle portions 4 of the rod 1.

The auxiliary rod 28 according to FIGS. 11 to 13 is distinguished in that, at its free end piece, it has no lug introducibile into the slot of the drapery rod or of the insert piece, no tongues to be applied against the inner side of the angle portions 4 of the drapery rod 1, and no lug requiring support on the underside of the insert piece or of the drapery rod. The front end piece 42 of the otherwise straight auxiliary rod is slightly bent, and the auxiliary rod from being pushed too far into the curtain rod, supports the auxiliary rod at the transverse member of the insert piece, and holds the insert piece in its pushed back position.

In the embodiment according to FIG. 14, the auxiliary rod 28, which is curved or bent in front, has displaceable in it a push bar 44 which carries a grip piece 45 connected by slot 33 with the push bar. At the front end of the push bar 44, a flange 52 extending through slot 33 to the outside is provided, to which one end of a straight, rigid arm 53 is pivoted. At the front end of arm 53 a rigid band 54 is provided, directed toward the auxiliary rod, protruding through the slot 33 and carrying a roll type transverse member 55, which is guided in channel 32 of the auxiliary rod. Arm 53 is longer than the region of the auxiliary rod extending from the first bend of the auxiliary rod to the end thereof. The auxiliary rod 28 terminates at the top or in front in two tongues 36 and carries an intermediate piece 48 in front at the bridge-piece or respectively at the transverse member 29. At the upper edge of the intermediate piece 48, a stud type supporting member 49 is fastened, which can engage in the slot of the insert piece.

Instead of only one arm 53 with only one guided transverse member 55, there may be pivoted at the bend 54 another arm whose front or upper end is likewise guided through a bend and a transverse member in the channel of the auxiliary rod. At the straight, stretched region of the auxiliary rod, yokes spanning the angle portions and the slot may be provided, in which the arm or arms is or are guided when the push bar is pushed down and the arm is disposed in thr straight region of the auxiliary rod.

I claim:

1. The invention relates to a device for introducing and extracting drapery holding elements by hand or by means of an auxiliary rod having a C-shaped channel therein in and out of an opening in the slideway to a drapery rod of C-shaped cross-section, wherein the opening is closable by means of a movable insert piece and which comprises a channel for the drapery support elements protruding from the channel through a slot formed between the angle portions of the C-form, the insert piece comprising a zone of C-shaped cross-section which is shorter than the opening, comprising at one end an extrusion insertable into the channel of the drapery rod under the angle portions thereof and comprising at the other end two elastic tongues extending the angle portions of the C zone and slidable under the angle portions of the drapery rod, the length of the C zone and tongues being greater than the length of the opening, characterized in that at least one of the tongues (19) of the insert piece (10) carries on the outside, near its free end, a stop (22) which, when the extension (15) is pushed into the channel (6), bears against the edge (8)—associated with the tongues (19)—of the opening (7) of the C-shaped drapery rod (1) and is slidable with the tongues (19) under the angle portions (4) of the drapery rod (1).

2. Device according to claim 1, characterized in that, at the free end of the auxiliary rod (28), the transverse member (29) of the auxiliary rod has a guide extension (35) symmetrically tapering in width.

3. Device according to claim 1, characterized in that, at the free end of the auxiliary rod, bent tongues (36) prolonging the angle portions (31) of the auxiliary rod are provided.

4. Device according to claim 1, characterized in that at the end of the drapery rod (1), in the channel (6), a closure piece (37) is arranged, which is fastened on the angle portions (4) of the drapery rod by means of a clamping screw (39) and possesses in the channel a pair of resilient ratchet tongues (37), between which a leg or bridge-piece (26) of one of the drapery holing elements (25) is engageable.

5. Device according to claim 1, characterized in that a rigid straight push bar (44) is disposed in the auxiliary rod (28), outside the auxiliary rod, an arm (53) is pivoted whose other end carries a transverse member (55) which is displaceably guided in the channel (32) of the auxiliary rod.

6. Device according to claim 1, characterized in that the auxiliary rod (28) comprises a slightly bent end piece (42) tapering in cross-section, which can be introduced into the channel (6) of the drapery rod (1).

7. Device according to claim 1, characterized in that the auxiliary rod (28) carries, spaced from the free end, at the transverse member (29), a supporting member (49) of a frictional material.

8. Device according to claim 7, characterized in that the terminal area (50) of the tongues (36) at the free end of the auxiliary rod (28) and the topside (51) of the supporting member (49) run approximately parallel to each other.

9. Device according to claim 7, characterized in that at the auxiliary rod (28) a rigid intermediate piece (48) is fastened, on which the supporting member (49) is secured.

10. Device according to claim 7, characterized in that at the end of the auxiliary rod (28), at the transverse member (29) thereof, a lug (43) extending over the width of the bridge-piece is provided which, when the end of the auxiliary rod is pushed into the opening (7), bears against the transverse member (12) of the insert piece (10) and against the angle portions (14) of the C zone (11) of the insert piece.

* * * * *